US008640589B2

(12) United States Patent
Dryer et al.

(10) Patent No.: US 8,640,589 B2
(45) Date of Patent: Feb. 4, 2014

(54) PROJECTILE MODIFICATION METHOD

(75) Inventors: Richard Dryer, Oro Valley, AZ (US); Chris E. Geswender, Green Valley, AZ (US)

(73) Assignee: Raytheon Company, Waltham, MA (US)

( * ) Notice: Subject to any disclaimer, the term of this patent is extended or adjusted under 35 U.S.C. 154(b) by 451 days.

(21) Appl. No.: 12/839,756

(22) Filed: Jul. 20, 2010

(65) Prior Publication Data

US 2012/0017795 A1 Jan. 26, 2012

(51) Int. Cl.
*F42B 10/06* (2006.01)
*F42B 10/16* (2006.01)

(52) U.S. Cl.
USPC ..... 86/51; 102/473; 102/293; 102/517; 102/524

(58) Field of Classification Search
USPC ..... 102/293, 374, 376, 490, 517, 524, 526, 102/527, 473; 86/51; 244/3.24, 3.27, 3.29, 244/3.3
See application file for complete search history.

(56) References Cited

U.S. PATENT DOCUMENTS

| | | | | |
|---|---|---|---|---|
| 471,129 | A * | 3/1892 | Loveland et al. | 102/526 |
| 2,347,350 | A * | 4/1944 | Jung et al. | 72/88 |
| 2,793,591 | A | 5/1957 | Raymond | |
| 4,536,928 | A * | 8/1985 | Nicklas et al. | 86/51 |
| 4,825,518 | A * | 5/1989 | Schiestl et al. | 86/51 |
| 4,995,573 | A * | 2/1991 | Wallow | 244/3.24 |
| 5,661,258 | A * | 8/1997 | Garcia et al. | 102/402 |
| 6,227,096 | B1 * | 5/2001 | Thomas | 89/1.54 |
| 6,237,496 | B1 * | 5/2001 | Abbott | 102/384 |
| 6,540,176 | B2 * | 4/2003 | Davis et al. | 244/3.24 |
| 6,588,700 | B2 * | 7/2003 | Moore et al. | 244/3.28 |
| 7,849,800 | B2 * | 12/2010 | Hinsdale et al. | 102/501 |
| 7,947,938 | B2 * | 5/2011 | Dryer | 244/3.21 |
| 8,546,736 | B2 * | 10/2013 | Dryer | 244/3.21 |
| 2002/0088897 | A1 | 7/2002 | Davis et al. | |
| 2003/0071166 | A1 | 4/2003 | Moore et al. | |

FOREIGN PATENT DOCUMENTS

| | | | |
|---|---|---|---|
| FR | 2559256 | A1 | 8/1985 |
| FR | 2641069 | A1 | 6/1990 |
| WO | 2007/058573 | A2 | 5/2007 |

OTHER PUBLICATIONS

International Search Report and Written Opinion from corresponding International Application No. PCT/US11/30663.

* cited by examiner

*Primary Examiner* — James Bergin
(74) *Attorney, Agent, or Firm* — Renner, Otto, Boisselle & Sklar, LLP

(57) ABSTRACT

A method of modifying a projectile includes removing material from an aft end of the projectile, and coupling a device to the aft end. The method may be used to convert a spin-stabilized projectile into a fin stabilized projectile, by modifying the aft end of a spin-stabilized projectile to accept a fin kit. The modifying may involve removing material with lathe, and may include forming external threads on the aft end that may engage corresponding internal threads on the device, to effect the coupling of the device to the aft end. The modification method allows versatility in employing projectiles, including existing stocks of projectiles. In particular the method allows spin-stabilized projectiles to be converted to more accurate fin-stabilized projectiles.

10 Claims, 6 Drawing Sheets

PROJECTILE MODIFICATION METHOD

BACKGROUND OF THE INVENTION

1. Technical Field of the Invention

The invention is in the field of gun-fired projectiles.

2. Description of the Related Art

Projectiles, such as artillery projectiles, have long been used in warfare. There is a general desirability for improving all aspects of such projectiles, including accuracy.

SUMMARY OF THE INVENTION

According to an aspect of the invention, an existing projectile is modified by removing material, and a device is installed on the modified aft end.

According to another aspect of the invention, an existing projectile is modified by forming threads on its aft end, and a device that engages the threads is installed on the modified aft end.

According to yet another aspect of the invention, a tail fin kit to be installed on an existing projectile includes a base, and fins coupled to the base. The fins may have a curved shape, and may initially be in a recess in the base.

According to a further aspect of the invention, a method of modifying a projectile includes the steps of: removing material from an aft end of the projectile; and coupling a device to the aft end of the projectile.

According to a still further aspect of the invention, a projectile includes: a projectile body; and a tail fin kit coupled to an aft end of the projectile body. The tail fin kit includes a base and fins hingedly coupled to the base.

According to another aspect of the invention, a tail fin kit for retrofit on a projectile includes: a hollow base with internal threads for coupling with external threads of the projectile; and fins hingedly coupled around a perimeter of the base.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

DETAILED DESCRIPTION

A method of modifying a projectile includes removing material from an aft end of the projectile, and coupling a device to the aft end. The method may be used to convert a spin-stabilized projectile into a fin stabilized projectile, by modifying the aft end of a spin-stabilized projectile to accept a fin kit. The modifying may involve removing material with lathe, and may include forming external threads on the aft end that may engage corresponding internal threads on the device, to effect the coupling of the device to the aft end. The modification method allows versatility in employing projectiles, including existing stocks of projectiles. In particular the method allows spin-stabilized projectiles to be converted to more accurate fin-stabilized projectiles.

Figure 1:
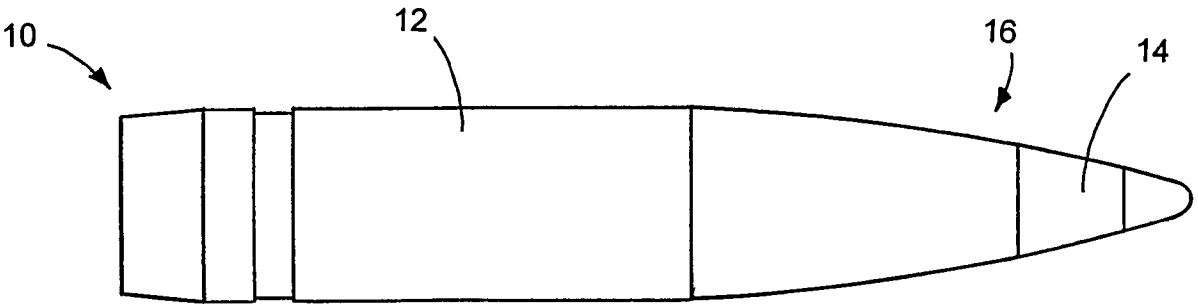
FIG. 1 is a side view of an unmodified projectile that is a starting point, according to an embodiment of the present invention.

FIG. 1 shows a projectile 10 in its unmodified form. The term "projectile," as used herein, is defined as an object that is intended to be shot from a gun (launcher with a barrel having a muzzle)), and that is capable of withstanding the accelerations (forces) involved in such gun launching. The projectile 10 has a projectile body 12, with a fuze 14 installed in a front or forward end 16 of the body 12. The fuze 14 is installed in the field, into a suitable opening in the front end 16 of the projectile body 12. A closure plug may be placed in the opening for the fuze 14 during shipment of the projectile 10, prior to the installation of the fuze 14.

Figure 2:
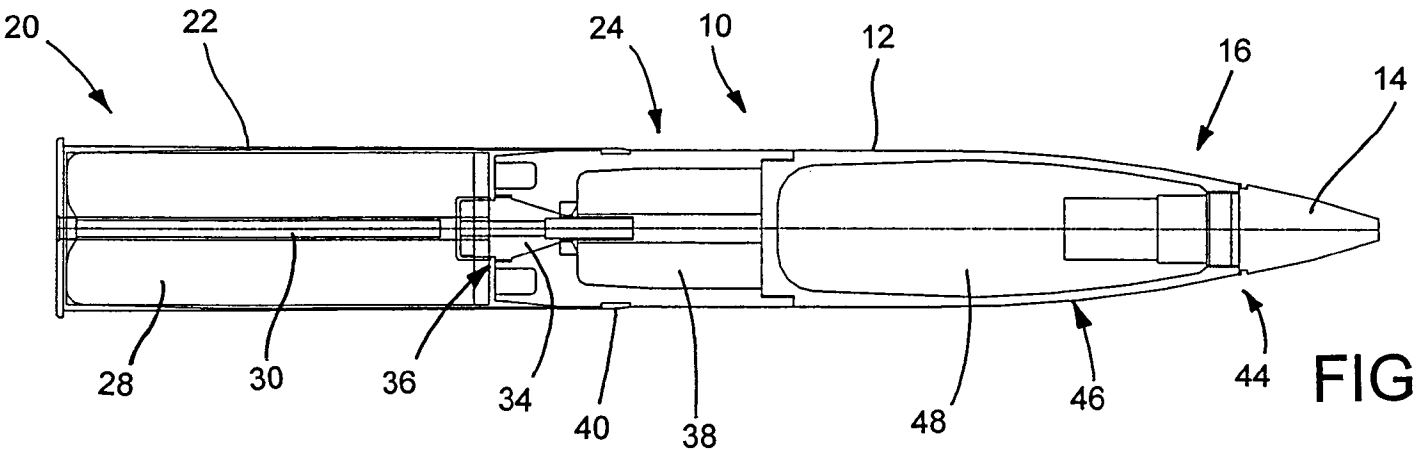
FIG. 2 is a side cross-sectional view of a cartridge that includes the unmodified projectile of FIG. 1.

FIG. 2 shows the projectile as part of a cartridge 20. The cartridge includes a casing 22 that couples to an aft end 24 of the projectile body 12. The casing 22 encloses a propellant 28 and a primer 30. The primer 30 may be used to initiate combustion of the propellant 28, providing the force to drive the projectile 10 out of the cartridge casing 22, and out of a gun or other launcher (not shown) that the cartridge 20 is fired out of. An igniter 34 is located in an aft opening 36 of the projectile body 12. The igniter 34 is used to initiate the rocket propellant 38 that is located in the projectile body 12. The rocket motor igniter 34 is optionally employed so that the trajectory of the projectile 10 may be extended at the user's discretion. The illustrated embodiment is a rocket-assisted projectile. However, it will be appreciated that the modification method described herein is not limited to employment with rocket-assisted projectiles, and may be employed on a variety of types of conventional projectiles, including but not limited to high explosive projectiles, projectiles with base burners, cargo projectiles, etc.

The cartridge 20 may include a rifling band 40 that provides a pressure seal that prevents flow of high-pressure gases around the aft end 24 of the projectile body 12. This keeps the high-pressure gases behind the projectile 10, to drive the projectile 10, rather than dissipating the pressure by allowing some of the high-pressure gas to "leak" around the projectile body 12. The rifling band 40 or other structure on the projectile 10 may be configured to engage rifling in the gun or other launcher, to spin the projectile 10 during launch.

FIG. 2 also shows the forward opening 44 that receives the fuze 14. The fuze 14 may any of a variety of different types of fuzes, with different characteristics, the forward part of the projectile 10 may also include a payload, such as a warhead 46, for example including a high explosive 48.

Figure 3:
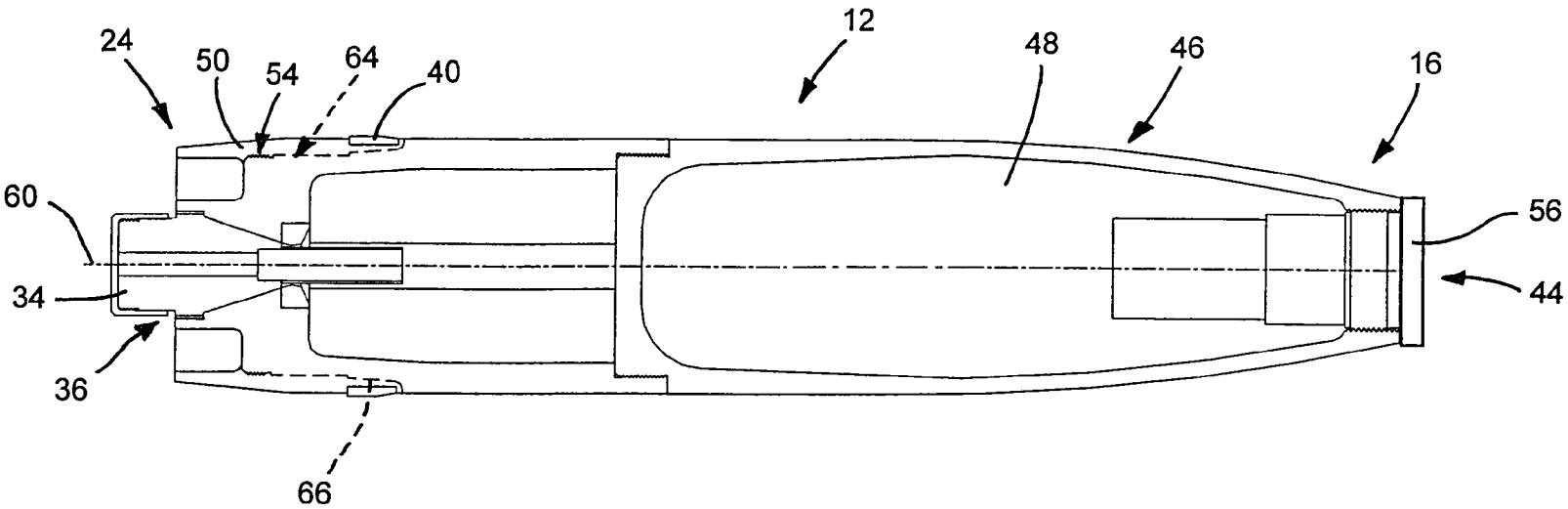
FIG. 3 is a side cross-sectional view of the fuselage of the projectile of FIG. 1, showing areas of the projectile that are removed as part of the modification method in accordance with an embodiment of the invention.
Figure 4:
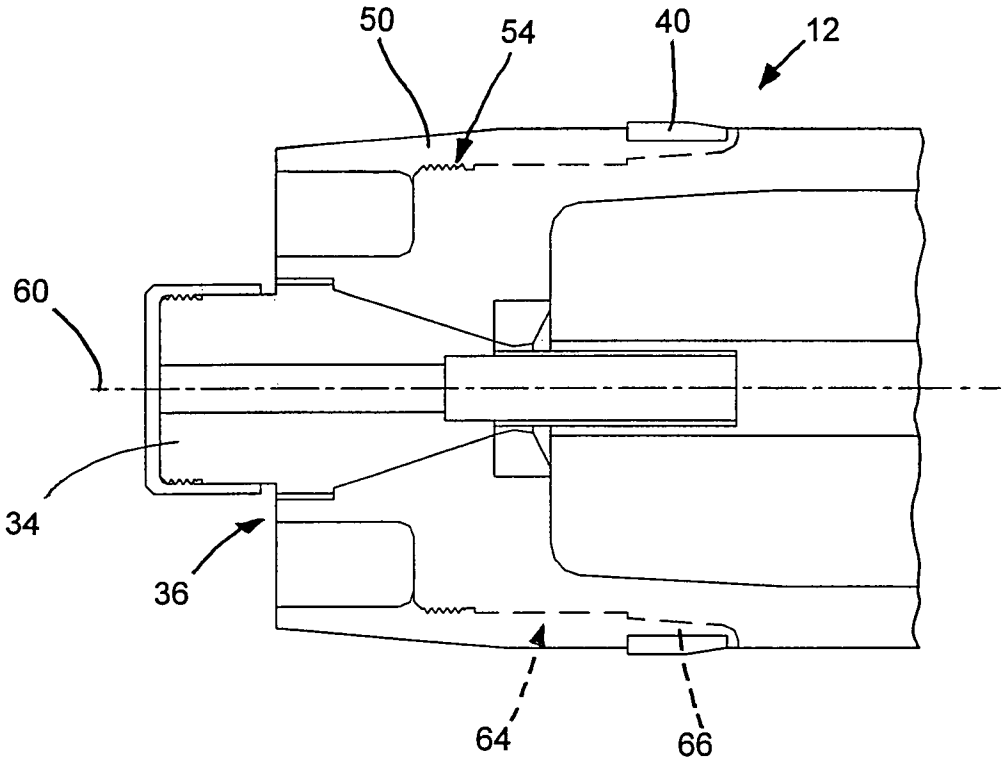
FIG. 4 is a magnified view of an aft portion of the fuselage of FIG. 3.

FIGS. 3 and 4 illustrate the material removal from the projectile aft body 24 in order to modify the projectile body 12 to receive a device, such as a tail fin kit, as described further below. The material may be removed, as shown at 50, to create radial space around the outside of the projectile body 12 for the device. The rifling band 40 is also removed. In addition the removal of material includes producing external threads 54 on part of the aft body 24. The external threads 54 may be configured to engage internal threads on the device that is later coupled onto the modified projectile aft end.

The removing of the material 50 may be accomplished by use of a lathe (not shown). The projectile body 12 may be secured to the lathe using openings in projectile body 12 that are along a longitudinal axis 60 of the body 12. In particular, the front end 16 may be secured by insertion of an inert loading plug 56 in the forward opening 44, and by use of a chuck or other holder the body of the projectile 10. The inert loading plug 56 prevents the fuze 14 (FIG. 1) from introducing additional hazards into the projectile modification process. The aft end 24 may be secured by placement of a plug or other locator into the aft opening 36 (after removal of the igniter 34), to produce a pilot surface for the lathe.

It will be appreciated that any of a variety of suitable lathes may be used in modifying the aft end 24. Lathes have the advantage of easily making axisymmetric surfaces, and features such as the external threads 54. A robotic lathe may be particularly effective in making accurate and repeatable modifications of projectile aft ends, and would be advantageous in modifying existing projectiles, which may be filled with explosive or other energetic materials. However it will be appreciated that alternatively or in addition other sorts of tools may be used in removing the material 50, and/or in otherwise modifying the projectile aft end 24.

The removal of the material 50 may be accomplished on existing projectiles. In particular the machining may be performed on live projectiles, projectiles having a warhead, rocket motor or other energetic materials.

The removing of the material 50 may create any of a variety of suitable shapes for receiving a device on the aft end 24 of the projectile 12. One suitable shape is illustrated in FIGS. 3 and 4, with the modified aft end shape having a cylindrical device-receiving surface 64, with the external threads 54 cut into the aft end of the surface 64. Forward of the device-receiving surface 64 is a curved recess 66 for receiving a slipping obturator, as described further below.

Figure 5:
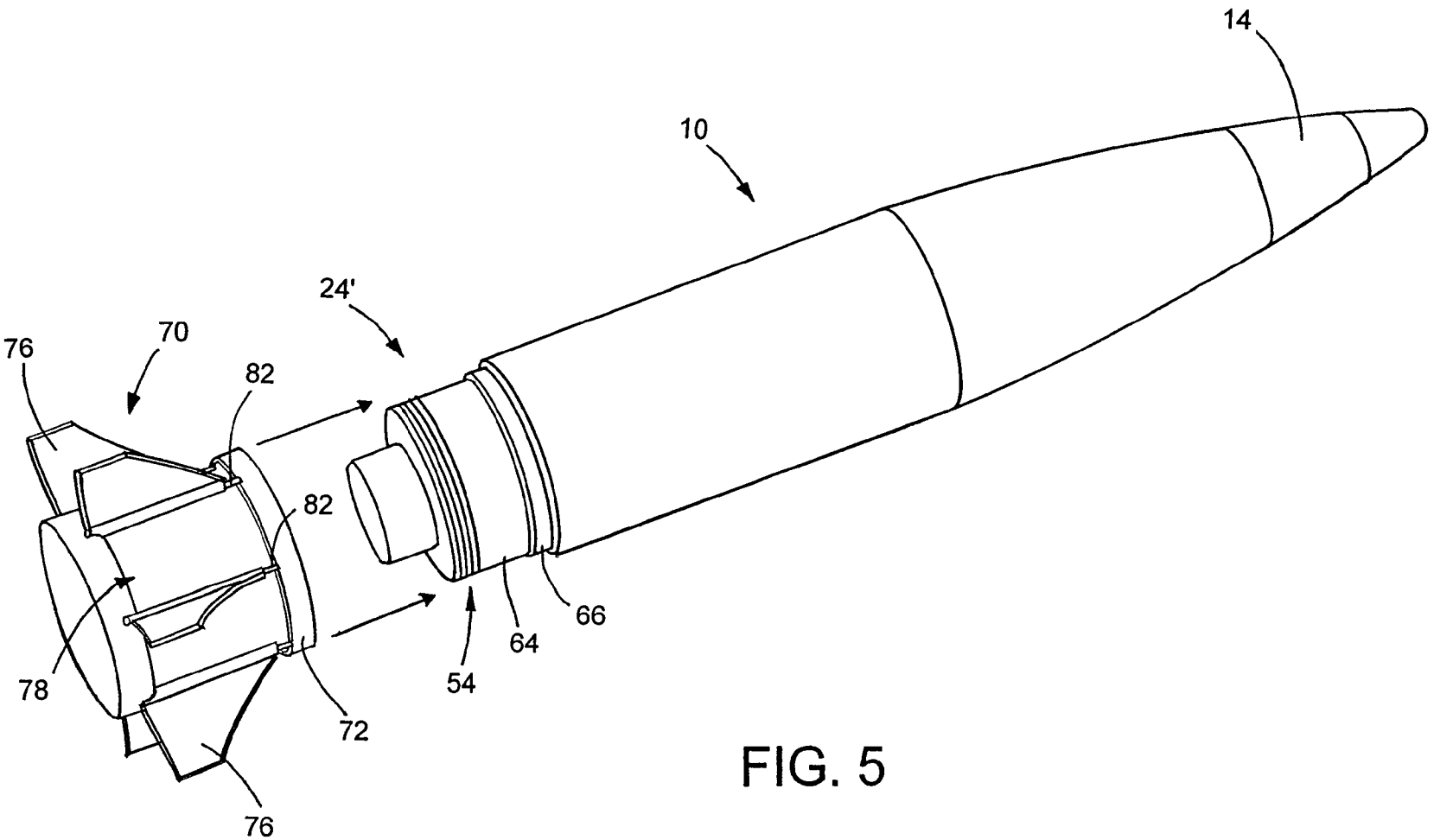
FIG. 5 is an oblique view showing parts of a modified projectile in accordance with an embodiment of the present invention.

The removal of the material 50 creates the modified aft end 24' shown in FIG. 5. FIG. 5 also illustrates one example of a device that may be coupled onto the modified aft end 24', a tail kit 70. The tail kit 70 includes a base 72, and a number of fins 76 hingedly coupled to the base 72. The illustrated embodiment shows the tail kit 70 as having six fins 76, but it will be appreciated that a greater or lesser number of fins could be employed.

Figure 6:
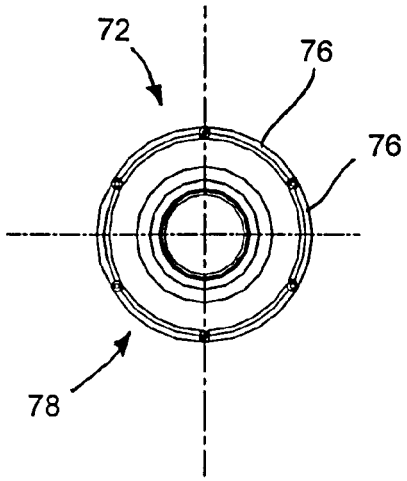
FIG. 6 is an end view of a tail fin kit of the modified projectile of FIG. 5, with fins of the kit in a stowed condition.

FIG. 6 shows the fins 76 in a stowed or folded state or condition, with the fins 76 located within a recess 78 around the perimeter of the base 72. The fins 76 may have curved shapes that aid in keeping them within the recess 78 when the fins 76 are in the stowed condition. Alternatively it will be appreciated that the fins 76 may be planar, or have other suitable shapes or configurations.

Figure 7:
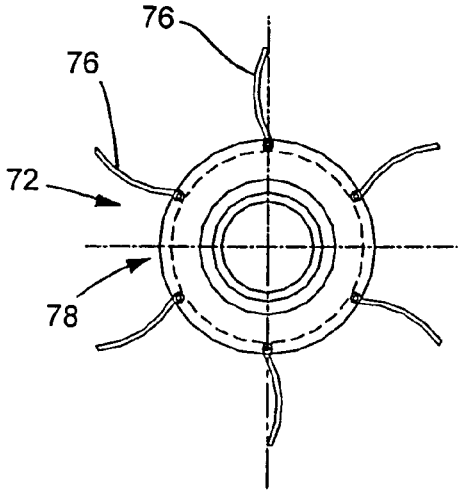
FIG. 7 is an end view of a tail fin kit of the modified projectile of FIG. 5, with fins of the kit in a deployed condition.

FIG. 7 shows the fins 76 in a deployed state or condition. In the deployed state the fins 76 are in the airstream surrounding the projectile 10. The deployed fins 76 provide stability to the flight of the projectile 10.

Figure 8:
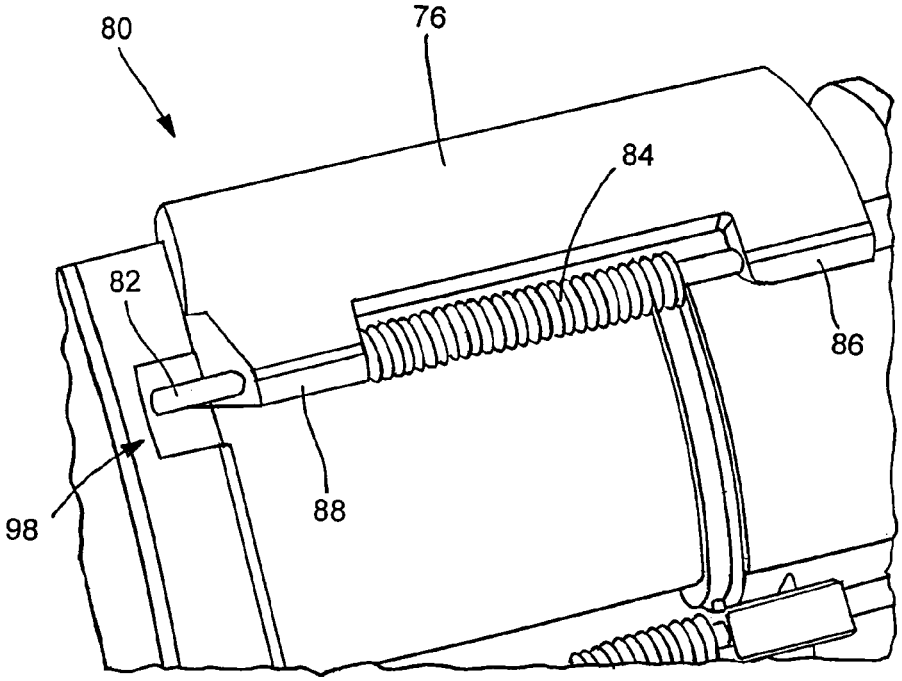
FIG. 8 is an oblique view of part of the tail fin kit of FIGS. 6 and 7, showing details of a fin deployment mechanism.
Figure 9:
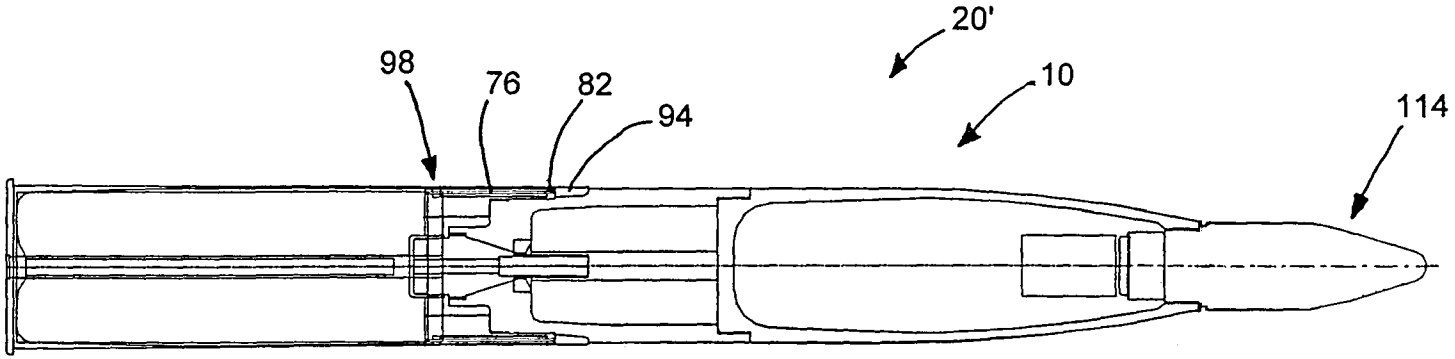
FIG. 9 is a side sectional view showing the modified projectile of FIG. 5 as part of a cartridge.

FIG. 8 illustrates a deployment mechanism 80 used in extending the fins 76 from their initial stowed state. With reference in addition to FIG. 9, which shows the modified projectile 10 as part of a modified cartridge 20', the fins 76 pivot around pins 82, driven by spring forces from springs 84. The springs 84 are wrapped around the pins 82, between a pair of fin protrusions 86 and 88 that also encircle the pin 82. In the stowed condition the springs 84 are preloaded with both compression and torsion forces.

A slipping obturator 94 of the modified projectile 10 may be used to keep the fins 76 in the stowed condition while the projectile 10 is in a barrel of a gun or other launcher. Alternative design features can be employed to restrain the tail fins 76 prior to firing the projectile 10. For instance, a separate retaining band can be provided to restrain the tail fins 76 during storage, handling and loading. This retaining band would be fabricated from some suitable frangible material which would disintegrate during the gun firing event, leaving the tail fins free to deploy at muzzle exit. The barrel keeps the obturator 94 in place prior to and during the launch process. As the projectile 10 exits the muzzle of the gun or other launcher, the obturator 94 (no longer restrained by the barrel) falls away, and no longer keeps the fins 76 in place. The obturator 94 may be fabricated from a polymer material, and may be overcome by the forces experienced at muzzle exit and are discarded from the projectile 10. The fins 76 rotate outward into the air stream under torsion forces from the preloaded springs 84. When the fins 76 deploy far enough, they align with fin lock notches 98 in the base 72. The compression force from the springs 84 drives the fins 76 in a direction along the longitudinal axes of the pins 82, into the fin lock notches 98. This fixes the fins 76 in the deployed condition, preventing the fins 76 from pivoting in either direction.

The slipping obturator 94 may be an obturator made of nylon (or another suitable material), so as to allow the modified projectile to be launched from a barrel having rifling or other spin-producing features, without achieving the full spin rate intended by such features. For example a spin-stabilized projectile may come out of a cannon (or other launcher) at an intended spin rate of 250-300 Hz. It may be desirable for the fin-stabilized modified projectile to have a much slower spin rate. The slipping obturator 94 acts as a clutch, engaging the rifling, but allow some slippage between the obturator 94 and the projectile body 12. This may allow the modified projectile 10 to emerge from the launcher at a small fraction of the full spin rate, for example at a spin rate of 20-30 Hz.

The modified cartridge 20' shown in FIG. 9 shows the projectile 10 as having a fuze 114 coupled to the projectile body 12. The fuze 114 may have different characteristics than the conventional fuze 14 shown in FIG. 1. It will be appreciated that the fuzes 14 and 114 are examples of a wide variety of possible fuze configurations usable as part of the projectile 10.

The various parts of projectile may be made from any of a variety of suitable material. It will be appreciated that 105 mm artillery shells or 155 mm artillery shells, to give two examples of projectiles, are made of well-known materials. The various parts of the tail fin kit 70 may be made of suitable materials. For instance the base 72, the fins 76, and the pins 82 may be made of aluminum or steel.

Although the modification method is described above in terms of putting a tail fin kit 70 on the aft end 24 of the projectile body 12, it will be appreciated that alternatively other devices may be placed on the modified aft end 24. Examples of other suitable devices include an additional rocket motor, a larger warhead, or an aft guidance kit. The modifications for utilizing these additional devices may be the same as those described above, or may involve removing material to achieve a different configuration.

The projectile 10 in the illustrated embodiment is only one of a wide variety of projectiles that may be modified according to the method described above. It will be appreciated that projectiles with various characteristics, such as various types of warheads or other payloads, various sizes, or the presence or absence of propulsion systems, may be modified as described above to receive a device such as a tail fin kit.

The modification method described above may have the benefit of allowing spin-stabilized projectiles to be converted into fin-stabilized projectiles. Fin-stabilized projectiles may be more accurate that spin-stabilized projectiles. Relying on fin stabilization may allow for additional control methods to be used to further increase accuracy of projectiles. The methods allow conversion of existing projectile stocks, and utilization of existing rifle-barreled launchers. It will be appreciated that the ability to convert extensive projectile stocks to improve accuracy provides a considerable benefit.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of modifying a projectile, the method comprising:

removing material from an aft end of the projectile; and coupling a device to the aft end of the projectile;

wherein the projectile is initially a spin-stabilized projectile; and wherein the device is a tail fin kit, such that the step of coupling transforms the projectile into a fin-stabilized projectile.

2. The method of claim 1, wherein the tail fin kit includes a base, and fins hingedly coupled to the base.

3. The method of claim 1, further comprising, prior to the coupling, placing a slipping obturator onto the aft end.

4. The method of claim 3, wherein the step of removing the material includes creating a cutout for the slipping obturator.

5. The method of claim 1, wherein the step of removing the material includes removing a rifling band on the aft end of the projectile.

6. The method of claim 1, wherein the step of removing material includes removing the material with a lathe; and further comprising, prior to the step of removing the material with the lathe, securing the projectile to the lathe by inserting a first holder into a forward opening of a projectile body of the projectile, and a second holder into an aft opening of the projectile body.

7. The method of claim 6, wherein the lathe is a robotic lathe.

8. The method of claim 6, further comprising, prior to the step of removing the material with the lathe, removing an igniter of the projectile, to produce a pilot surface for the lathe; and after the removing the material, replacing the igniter.

9. The method of claim 1, wherein the step of removing material includes forming threads on the aft end; and wherein the step of coupling includes threadedly coupling internal threads of the device onto the threads on the aft end.

10. The method of claim 1, further comprising:

securing a casing to the device, making the projectile part of a cartridge.

* * * * *